US006640766B2

(12) United States Patent
Furuya et al.

(10) Patent No.: US 6,640,766 B2
(45) Date of Patent: Nov. 4, 2003

(54) BEARING CASE FOR ENGINE

(75) Inventors: Akira Furuya, Tokyo (JP); Takao Sakai, Tokyo (JP)

(73) Assignee: Fuji Jukogyo Kabushiki Kaisha, Tokyo (JP)

( * ) Notice: Subject to any disclaimer, the term of this patent is extended or adjusted under 35 U.S.C. 154(b) by 0 days.

(21) Appl. No.: 10/054,129

(22) Filed: Jan. 22, 2002

(65) Prior Publication Data

US 2002/0112691 A1 Aug. 22, 2002

(30) Foreign Application Priority Data

Feb. 16, 2001 (JP) ..... 2001-039506

(51) Int. Cl.[7] ..... F02F 7/00
(52) U.S. Cl. ..... 123/195 R
(58) Field of Search ..... 123/195 R, 195 S, 123/195 C, 195 A, 195 H; 184/6.2, 6.5, 6.18, 11.1, 13.1

(56) References Cited

U.S. PATENT DOCUMENTS 4,256,069 A * 3/1981 Masuda et al. ..... 123/196 S
4,873,945 A * 10/1989 Tamba et al. ..... 123/54.4
5,960,764 A 10/1999 Araki ..... 123/196

FOREIGN PATENT DOCUMENTS

| | | |
|---|---|---|
| CH | 235424 | 11/1944 |
| EP | 1 072 770 | 1/2001 |
| GB | 1 101 580 | 1/1968 |
| WO | 99 45246 | 9/1999 |

* cited by examiner

*Primary Examiner*—Henry C. Yuen
*Assistant Examiner*—Hyder Ali
(74) *Attorney, Agent, or Firm*—Darby & Darby

(57) ABSTRACT

A main bearing case has a bearing holder for holding a bearing so as to support a crankshaft, and a crankcase mounting section at which it is joined to a crankcase. Rib walls are provided so as to surround the bearing holder between the bearing holder and the crankcase mounting section. The rib walls are formed in a side of the crankcase, and in a neighborhood of each inner side face of the bearing holder and the crankcase mounting section. These rib walls receive a force exerted in a radial direction from the crankshaft. Thereby, an improvement of rigidity of the main bearing case can be achieved, and also the lubrication to a valve-operating system can be always ensured by preventing an oil surface from lowering even when an engine is located with inclination.

9 Claims, 6 Drawing Sheets

BEARING CASE FOR ENGINE

BACKGROUND OF THE INVENTION

1. Field of the Invention

The present invention relates to a bearing case for securely accommodating a bearing for supporting a crankshaft of an engine.

2. Description of the Related Art

General-purpose engines of an overhead valve (OHV) type or an overhead camshaft (OHC) type are widely used as power sources for lawn mowers, power-driven sprayers, generators, and others. The crankshaft of such engines is generally supported by ball bearings (hereinafter referred to simply as "bearing"). In most cases, the crankshaft is supported at both ends thereof by the bearings.

The bearings are held by a crankcase and a main bearing case (hereinafter referred to simply as "bearing case") mounted thereto. Generally, the bearing on one side is accommodated in and held by a bearing holder provided at a wall of the crankcase, while the other bearing is accommodated in and held by the bearing case.

FIG. 6 is a cross-sectional view showing a structure of an engine using a conventional bearing case. The conventional bearing case 100 includes a bearing holder 102 protruded at the center of a side wall 101 thereof as shown in FIG. 6. Along an outer periphery of the bearing case 100 is formed a crankcase mounting section 103 (hereinafter referred to simply as "mounting section") which is to be joined to a cover mounting surface of the crankcase through a gasket. A hollow 104 is formed between the mounting section 103 and the bearing holder 102. The bearing holder 102 accommodates a ball bearing (not shown) therein and thereby supports one end of the crankshaft.

The engine as shown in FIG. 6 includes an oil pan 107 formed in a lower portion of the crankcase 106, where a lubricating oil 108 is stored. The lubricating oil 108 is picked up by an oil dipper 110 with a rotation of the crankshaft 109, droplets of which lubricates a valve-operating system such as a chain and sprockets (both not shown).

The crankshaft is subjected to a force exerted orthogonally to an axial direction thereof also in an explosion stroke. The bearing accordingly receives the force exerted thereto in a radial direction orthogonal to the crankshaft in addition to the force in a rotational direction thereof. The bearing case 100 shown in FIG. 6 receives such force by just the bearing holder 102.

In the bearing case 100, however, the mounting section 103 overhangs from the bearing holder 102, and thus when subjected to a radially acting force, the bearing holder 102 warps from its base end, resulting in deformation in the side wall 101. The radially exerted force also acts on the mounting section 103 as moment, whereupon a compressive force and a shearing force act between the mounting section 103 and the crankcase 106. The gasket interposed therebetween is subjected to such forces repeatedly and is accordingly deformed over and over again. Thus, deterioration of the gasket proceeds quickly, leading to the risk of oil leakage.

In the high-performance engines with higher speed for higher output in recent years, the bearing holder 102 is subjected to ever increasing load. The bearing case shown in FIG. 6 is hardly capable of withstanding such load, and therefore an improvement in the structure of bearing case has been desired.

On the other hand, when the engine of FIG. 6 is inclined and located on a slope, an oil surface of the lubricating oil 108 stored in the crankcase 106 is inclined as shown by a dotted line in FIG. 6. In short, the lubricating oil 108 enters an hollow forming a part of an oil pan in a lower portion of the bearing case 100 more and more by the inclination, whereby a slope of the oil surface is formed at a right side of the oil pan. Thus, the oil dipper 110 results in no-touch with the oil surface, so that the lubricating oil 108 can not be fully supplied to the valve operating system.

SUMMARY OF THE INVENTION

An object of the present invention is to provide a bearing case with more rigidity which secures a valve-operating system to be fully lubricated even when the engine is located with inclination.

In order to achieve the object, there is provided a bearing case attached to a crankcase of an engine in order to hold a bearing for supporting a crankshaft of the engine, comprising a bearing holder for holding the bearing, a crankcase mounting section formed on an outer peripheral surface of the bearing case to be joined to the crankcase, and rib walls formed so as to surround the bearing holder and extend from the bearing holder to the crankcase mounting section, wherein the rib walls are located adjacently to a side end surface of a crankcase.

According to the present invention, a force acting on the bearing holder in a radial direction from the crankshaft is received by rib walls, so that the bearing holder can be prevented from warping at its base end as the conventional bearing case. Also, the crankcase mounting section receives less moment, whereby its movement is restricted. As a result, damage to the gasket caused by deformation or play of the bearing case can be prevented, whereby the lifetime and reliability of the product are improved.

In addition, since the rib walls are provided in a side of a crankcase, a gap forming a part of an oil pan within the bearing case becomes small, so that it becomes possible to prevent the lubricating oil from entering the bearing case and thus the oil surface of the oil pan from lowering. Therefore, even if the engine is located with inclination, the oil dipper always sinks below the oil surface, thereby the lubrication to the valve-operating system can be stably ensured.

BRIEF DESCRIPTION OF THE DRAWINGS

These and other objects and advantages of the present invention will become clearly understood from the following description with reference to the accompanying drawings, wherein.

DETAILED DESCRIPTION OF THE PREFERRED EMBODIMENTS

Preferred embodiments of the present invention will be hereinafter described in detail with reference to the accompanying drawings.

Figure 1:
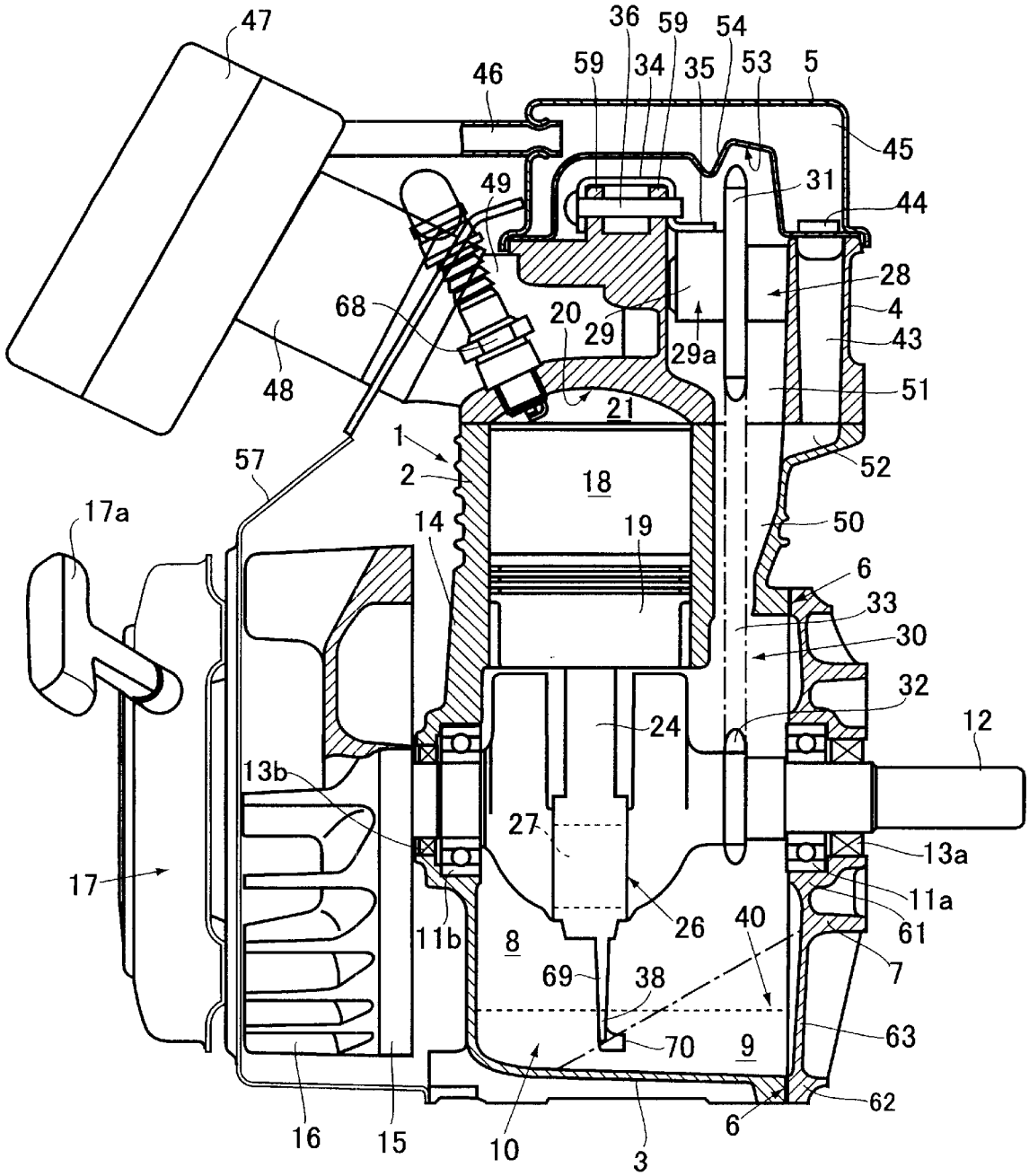
FIG. 1 is a diagram given in explanation of the structure of an OHC engine in which a bearing case according to one embodiment of the present invention is applied.
Figure 2:
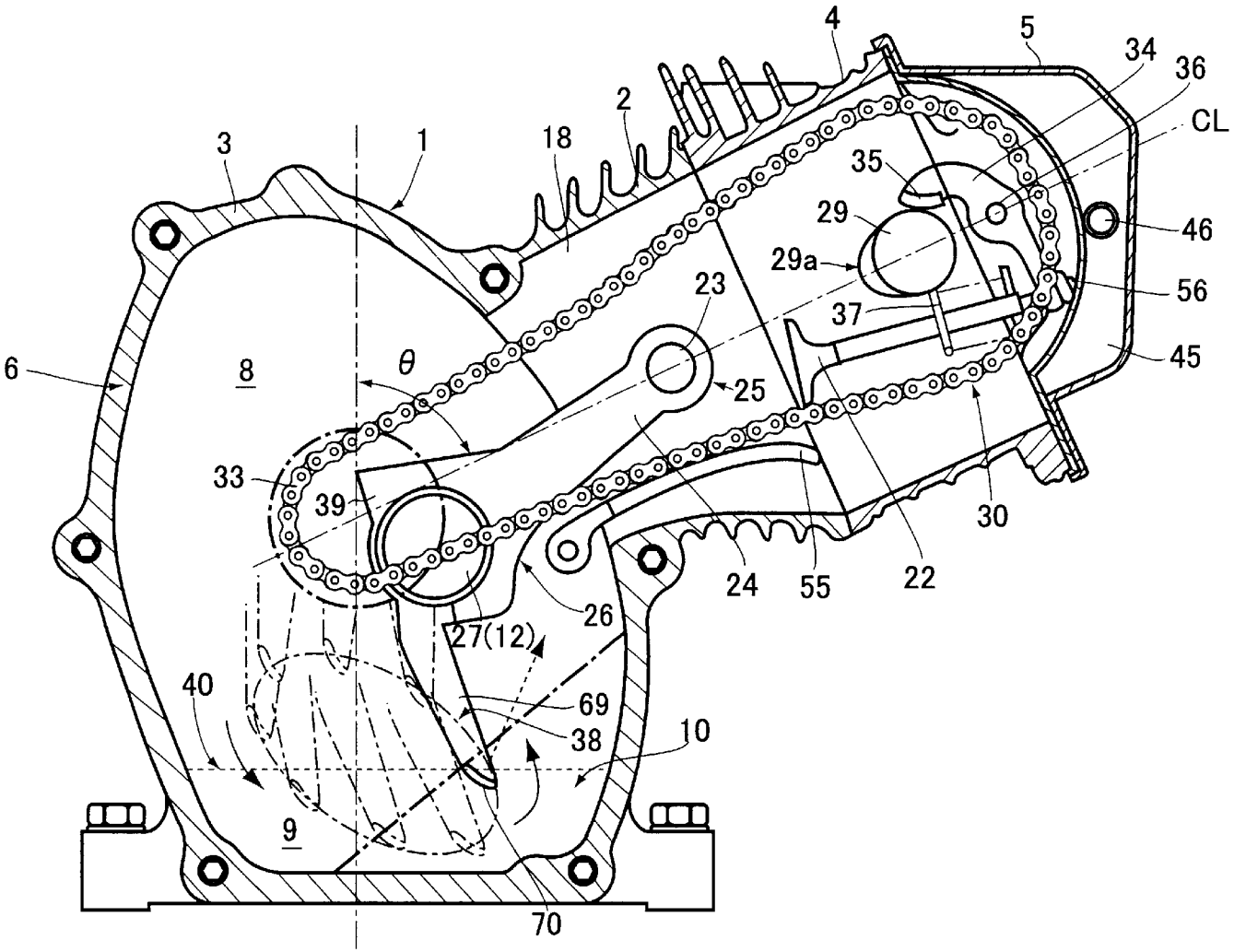
FIG. 2 is an explanatory cross-sectional view along a direction of an axis of a cylinder in the engine of FIG. 1.

FIG. 1 is a diagram given in explanation of the structure of an OHC engine in which a bearing case according to one embodiment of the invention is applied. FIG. 2 is an explanatory cross-sectional view taken along a direction of the cylinder axis of the engine of FIG. 1. The engine of FIG. 1 is a single-cylinder 4-cycle gasoline engine, and is a so-called "inclined OHC engine" in which a cylinder axis CL is inclined by an angle θ with respect to the gravitational direction (see FIG. 2). In the engine, an engine body 1 includes a cylinder block 2 and a crank case 3 which are integrally formed with each other. The engine body 1 is made of iron or a light metal alloy such as an aluminum alloy. A cylinder head 4 made of the aluminum alloy is attached to an upper portion of the cylinder block 2. A rocker cover 5 made of a sheet metal or a synthetic resin is mounted on a top of the cylinder head 4.

The crank case 3 has a large opening on the right side thereof in FIG. 1, where a main bearing case attachment surface 6 is formed. A main bearing case 7 (hereinafter referred to simply as "bearing case") made of the aluminum alloy is attached to the main bearing case attachment surface 6. Thus, a crank chamber 8 is provided in the crank case 3, and an oil pan 10 is provided under the crank chamber 8 for storing a lubricating oil (hereinafter referred to simply as "oil") 9.

A main bearing 11*a* is press-fitted into the bearing case 7, and one end of a crankshaft 12 is supported by the main bearing 11*a*. An oil seal 13*a* is press-fitted on the outer side of the main bearing 11*a*.

Figure 3:
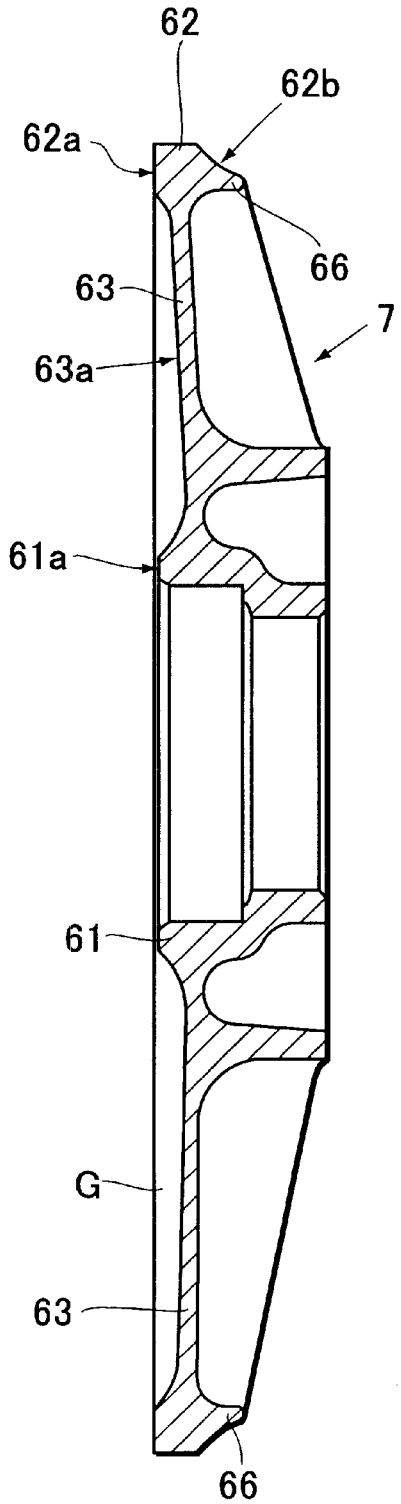
FIG. 3 is a cross-sectional view showing the structure of the bearing case according to the present invention.
Figure 4:
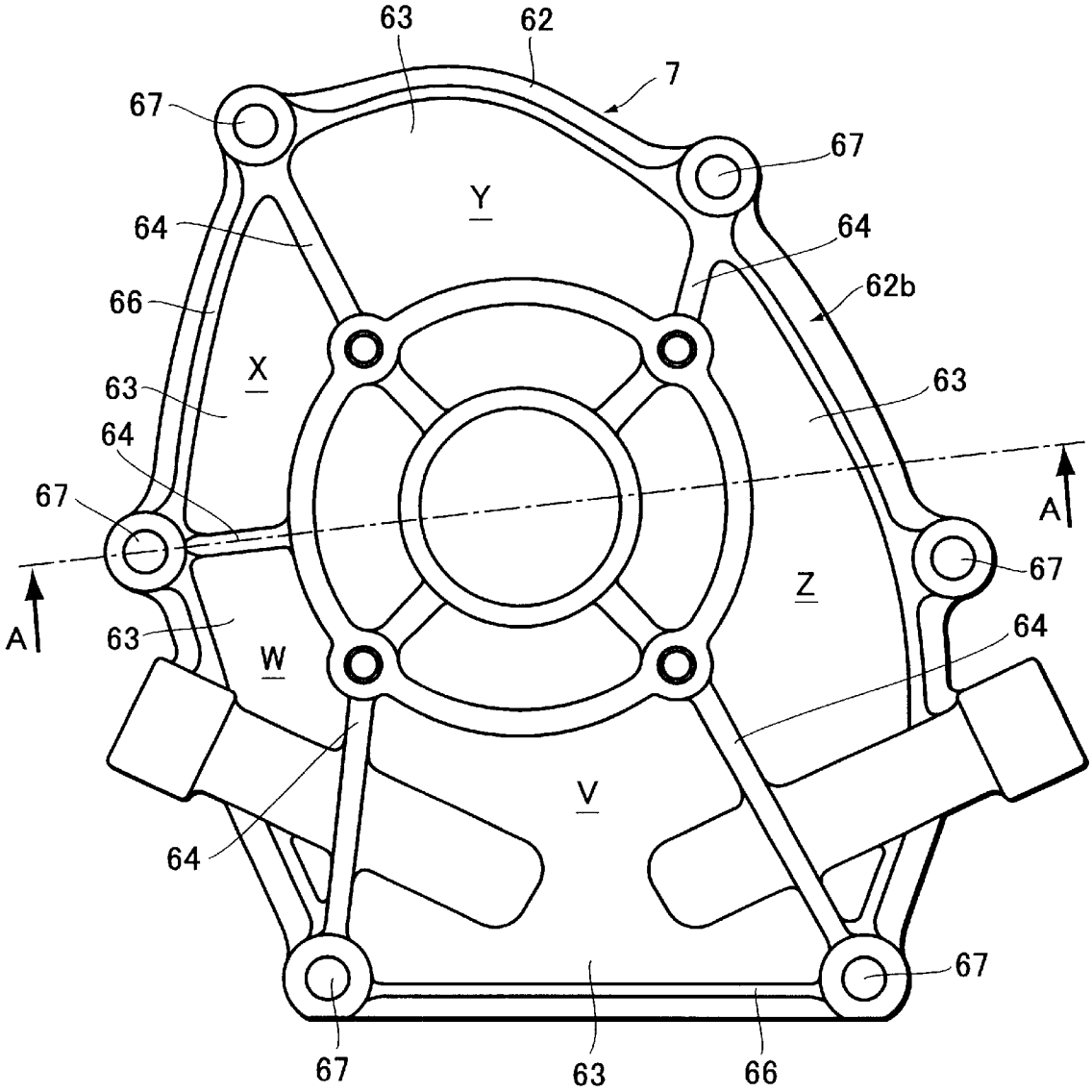
FIG. 4 is a right side view of the bearing case of FIG. 3.
Figure 5:
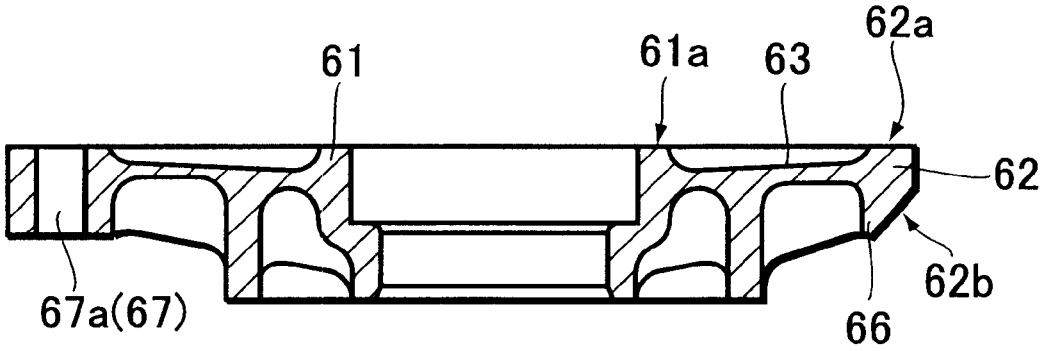
FIG. 5 is a cross-sectional view taken along the line A—A in FIG. 4.

FIG. 3 is a cross-sectional view of the bearing case 7, FIG. 4 being a right side view of same, and FIG. 5 being a cross-sectional view taken along the line A—A in FIG. 4. The bearing case 7 has a bearing holder 61 substantially at its center for holding and accommodating the main bearing 11*a*, as shown in FIGS. 3 and 5. The bearing case 7 also includes a crankcase mounting section 62 (hereinafter referred to simply as "mounting section") formed along its outer periphery, which is to be joined to the main bearing case mounting face 6 of the crankcase 3. The bearing case 7 is coupled to the crankcase 3 by bolts, and therefore the mounting section 62 includes a plurality of bolt holes 67 for passing the bolts through (see FIG. 4). Although not shown, a gasket is interposed between the main bearing case mounting face 6 and the mounting section 62.

The crankshaft 12 receives a cyclic force at an expansion stroke of a combustion as mentioned above which is exerted in a radial direction thereof. Accordingly, the bearing holder 61 is subjected to such a force through the main bearing 11*a*. Then, the bearing case 7 according to the present invention is provided with rib walls 63 around the bearing holder 61 along all periphery thereof, which receives a load from the crank shaft 12.

More specifically, as shown in FIGS. 3 and 4, the bearing case 7 includes a plurality of rib walls 63 with a substantially plane surface around the bearing holder 61 at a side of the crank case 3, that is, a left side in FIG. 3. The rib walls 63 extend from the neighborhood of an inner side end 61*a* of the bearing holder 61 toward the neighborhood of an inner side end 62*a* of the mounting section 62, thereby directly connecting the bearing holder 61 with the mounting section 62. Referring now to FIG. 4, the five faces V, W, X, Y, and Z surrounded by radially extending ribs 64 construct the rib walls 63. In addition, a wall surface 63*a* of the rib wall 63 is located so as to allow a step difference between itself and each inner side end 61*a*, 62*a* to be small, so that a gap G formed by the rib wall surface 63*a* between itself and the crankcase 3 can be kept to be smaller than that of the conventional bearing case as shown in FIG. 3.

Therefore, the force which is exerted in a radial direction thereof to the bearing holder 61 via-the crankshaft 12 as mentioned above is transmitted to the rib walls 63, so that the bearing holder 61 is supported by the rib walls 63. Thus, the bearing holder 61 does not warp or distort itself at its base end as in the prior art, and the bearing case 7 can be accordingly prevented from being deformed. Also, the mounting section 62 receives less moment, resulting in less play thereof. In other words, the overall rigidity of the bearing case 7 is improved, whereby damage to the gasket can be prevented, leading to the improved lifetime and reliability of the product.

Additionally, the rib wall 63 of the bearing case 7 is formed in the neighborhood of the crank case 3 so as to allow the gap G to be formed with a small space, whereby the small gap G can prevent that an oil surface of the oil pan lowers because the oil 9 enters the bearing case 7 due to the inclination of the engine. Thereby, even when the engine is inclined as indicated by a one-dotted-chain line in FIG. 1, a scraper 38 for lubricating a valve-operating system can contact with the oil surface 40 so as to scrape out the oil 9 with a rotation of the crank shaft 12. In other words, even when the oil surface 40 is inclined by setting the engine on a slope, the oil 9 can be supplied to a valve-operating system 30, thus the lubrication thereof being ensured.

Furthermore, the bearing case 7 of the present invention is provided with a reinforcing rib 66 at an outer side face 62*b* of the mounting section 62 as shown in FIG. 3. The reinforcing rib 66 is disposed in such a manner that each bolt hole 67 is connected with each other (see FIG. 4).

Figure 6:
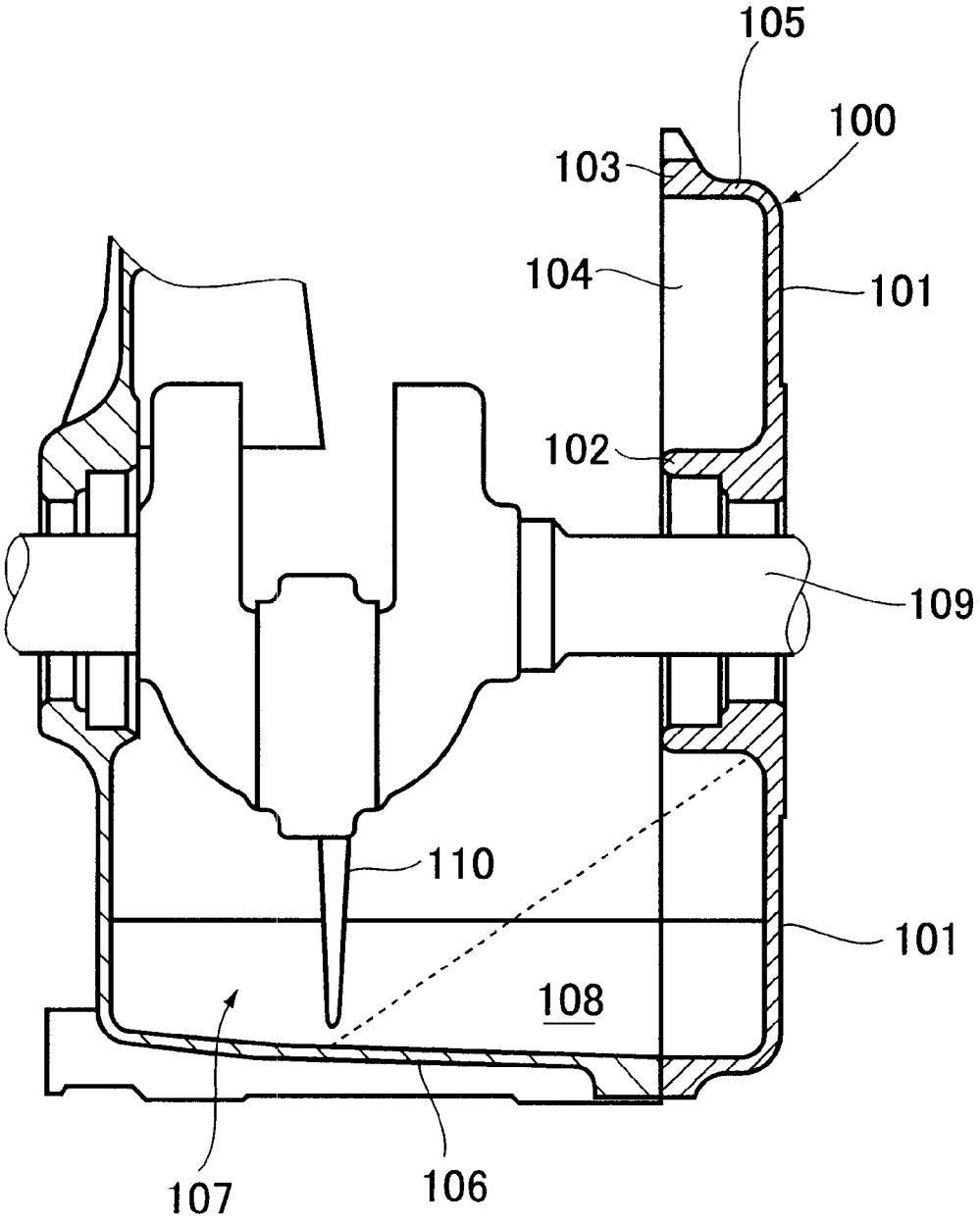
FIG.6 PRIOR ART
FIG. 6 is a cross-sectional view given in explanation of the structure of the engine in which a conventional bearing case is applied.

In the prior art shown in FIG. 6, the rigidity in the surface direction of the bearing case 100 (hereinafter referred to simply as "surface rigidity") was secured by the outer peripheral wall 105 extending along the mounting section 103. In the bearing case 7 of the present invention, a board thickness of the rib wall 63 and the reinforcing rib 66 ensures the surface rigidity. In other words, the bearing case 7 of the present invention ensures rigidity of the case itself due to the both of the rib wall 63 and the reinforcing rib 66, withstanding the force exerted orthogonally to the crankshaft 12.

Another main bearing 11*b* is press-fitted into a wall surface 14 of the crank case 3 opposite to the main bearing case attachment surface 6 (see FIG. 1). The other end side of the crankshaft 12 is supported by the main bearing 11*b*. Similarly to the oil seal 13*a*, an oil seal 13*b* is provided on the outer side of the main bearing 11*b*. The oil seals 13*a* and 13*b* prevent the oil 9 stored in the oil pan 10 from leaking out of the crank case 3 along the crankshaft 12.

A flywheel 15 and a cooling fan 16 are attached to the other end portion of the crankshaft 12 that extends out of the crank case 3 through the wall surface 14. The cooling fan 16 is provided outside the crank case 3 and within a casing 57, and rotates together with the crankshaft 12 so as to introduce a cooling air from an outside of the casing 57. The engine body 1 and the cylinder head 4 are cooled by the introduced cooling air. Moreover, a recoil device 17 is provided on the outer side of the casing 57. By pulling a recoil lever 17*a* by hand, the crankshaft 12 is rotated to start the engine.

A cylinder bore 18 is formed in the cylinder block 2. A piston 19 is fitted within the cylinder bore 18 so as to be slidable therein. An upper end of the cylinder bore 18 is closed by the cylinder head 4, and an upper surface of the piston 19 and a bottom wall surface 20 of the cylinder head 4 together form a combustion chamber 21. An intake valve 22, an exhaust valve (not shown), and an ignition plug (not shown) are provided at an upper portion of the combustion chamber 21.

A small end portion 25 of a connecting rod 24 is rotatably connected to the piston 19 via a piston pin 23. A crank pin 27 of the crankshaft 12 is rotatably connected to a large end portion 26 of the connecting rod 24. Thus, the crankshaft 12 is rotated along with the vertical reciprocation of the piston 19.

A camshaft 28 is provided in the cylinder head 4 in parallel with the crankshaft 12 on the cylinder axis CL. The camshaft 28 includes a valve-operating cam 29 and a sprocket 31, which are integrally formed with each other. The valve-operating cam 29 is driven in synchronization with the crankshaft 12 by the valve-operating system 30.

A sprocket 32 is secured on the crankshaft 12. Chain chambers 50 and 51 are provided in the cylinder block 2 and the cylinder head 4, respectively, and the sprocket 31 and the sprocket 32 are connected to each other via a chain 33 provided in the chain chambers 50 and 51. The sprockets 31,32 and the chain 33 form the valve-operating system 30. The number of teeth of the sprocket 31 is twice as large as the number of teeth of the sprocket 32, so that the valve-operating cam 29 undergoes one revolution per two revolutions of the crankshaft 12. The chain 33 is provided with an appropriate tension by a chain tensioner 55.

The valve-operating cam 29 is provided with a cam surface 29*a*, and a slipper 35 formed at one end of a rocker arm 34 slidably contacts with the cam surface 29*a*. Two rocker arms 34 are provided respectively for intaking and exhausting air. Each of the rocker arms 34 is provided to rock around a rocker shaft 36 which is supported by a rocker support 59. The other end of each rocker arm 34 is connected to a top end portion of the intake valve 22 or an exhaust valve (not shown) via an adjust screw 56. The intake valve 22 and the exhaust valve are each driven as the rocker arm 34 is rocked by the valve-operating cam 29. The intake valve 22 and the exhaust valve are each biased by a valve spring 37 toward the closed position. Thus, the intake valve 22 is opened/closed along with the rotation of the valve-operating cam 29.

The valve-operating system 30 is lubricated by a scraper 38 provided on a large end portion 26 of the connecting rod 24. As illustrated in FIG. 2, the scraper 38 extends downward from a lower member 39 of the large end portion 26, i.e., in a radial direction of the crankshaft 12, and comprises an arm 69 extending from the lower member 39 and a dipping piece 70 provided at a tip portion of the arm 69, an overall configuration of which is formed with a L-shape. The dipping piece 70 is formed facing the valve-operating system 30 and extends in the axis direction of the crankshaft 12 as shown in FIG. 1. The scraper 38 rocks along with the rotation of the crankshaft 12 through a path as indicated by one-dotted-chain lines in FIG. 2. Thus, the oil 9 stored in the oil pan 10 is scraped up by the scraper 38, and the oil 9 is splashed onto the chain 33 when the scraper 38 comes out of the oil surface 40, thereby lubricating the valve-operating system 30.

Along with the rocking of the scraper 38, the oil 9 is scraped up by the dipping piece 70, and then is thrown toward a root end portion of a chain tensioner 55. A little amount of the droplets hit the inner wall of the crank case 3 and are bounced back toward the chain 33. In this way, droplets of the oil 9 can be supplied to the chain 33, thereby ensuring the supply of the oil 9 to the valve-operating system 30. As mentioned above, even if the engine is inclined (see FIG. 1), the dipping piece 70 can go under the oil surface 40, whereby the lubrication of the valve-operating system is not disturbed.

The oil 9 thus splashed onto the chain 33 is transferred toward the cylinder head 4 along with the movement of the chain 33, thereby lubricating the sprocket 31 also. Moreover, the sprocket 32 is also lubricated by the oil 9 attached on the chain 33.

On the side of the cylinder head 4, a little amount of the oil 9 attached on the chain 33 is shaken off by a centrifugal force. Specifically, as a portion of the chain 33 travels around the sprocket 31, a little amount of the oil 9 on one portion of the chain 33 is thrown off the chain 33 in the circumferential direction of the sprocket 31. In the illustrated engine, the rocker cover 5 is provided above the sprocket 31, and those droplets of the oil 9 hit a ceiling surface 53 of the rocker cover 5. The oil 9 attached onto the ceiling surface 53 runs down along the ceiling surface 53 and is returned into the oil pan 10 via the chain chambers 51 and 50.

The ceiling 53 of the rocker cover 5 includes a protrusion 54 as shown in FIG. 1, so that oil 9 attached on the ceiling 53 can readily drip therefrom. The protrusion 54 is positioned above the valve-operating cam 29 and the slipper 35 where they make sliding contact with each other, so that the sliding parts are lubricated by the dripping oil 9.

In the cylinder head 4, a gas-liquid separation chamber 43 is provided separately from the chain chamber 51. Another gas-liquid separation chamber 45 is provided in the rocker cover 5 and is communicated to the gas-liquid separation chamber 43 via a lead valve 44. The gas-liquid separation chamber 45 is connected to an air cleaner 47 via a blow-by passage 46. The air cleaner 47 is connected to an intake port 49 in the cylinder head 4 via a carburetor 48.

The gas-liquid separation chambers 43,45 are provided for separating a mist of the oil 9 from a blow-by gas when the blow-by gas stored in the crank chamber 8 is recirculated to the air cleaner 47. In the illustrated engine, the gas-liquid separation chamber 43 is opened to the chain chamber 50, which is provided separately from the cylinder bore 18. Thus, a gas inlet 52 is provided at the upper end portion of the chain chamber 50 of the cylinder block 2, and the blow-by gas, which has flowed into the chain chamber 50, flows into the gas-liquid separation chamber 43 via the gas inlet 52. As the blow-by gas flows through the gas-liquid separation chamber 43, the oil mist contained therein attaches to a wall surface of the gas-liquid separation chamber 43, thereby separating the oil mist from the blow-by gas. The oil component, which has been separated in the gas-liquid separation chamber 43, returns to the oil pan 10 via the wall surface of the gas-liquid separation chamber 43 and then the wall surface of the chain chamber 50.

The blow-by gas, which has flowed into the rocker cover via the lead valve 44, is subjected to a further oil mist separation process in the gas-liquid separation chamber 45. Specifically, the oil mist contained in the blow-by gas, which has entered the gas-liquid separation chamber 45, attaches to the wall surface of the gas-liquid separation chamber 45, thereby achieving a further gas-liquid separation. Moreover, an oil return hole (not shown) may be provided in the bottom surface of the rocker cover 5, whereby the oil 9, which has attached to the wall surface of the gas-liquid separation chamber 45, sequentially flows into the chain chambers 51 and 50 through the oil return hole and returns to the oil pan 10 via the wall surfaces of the chain chambers 51 and 50.

The present invention has been specifically described above with respect to a particular embodiment thereof. It is understood, however, that the present invention is not limited to the above-described embodiment, but rather various modifications can be made thereto without departing from the scope and spirit of the present invention.

For example, although the rib walls 63 are formed in a planar shape in the above mentioned embodiment, they may be formed with a spherical wall as one part of the spherical surface having a large radius around an axis center of the crankshaft, i.e., with a shape expanding in the right direction in FIG. 3. In other words, the rib walls may be formed in a spherical shape so as to further enhance the rigidity of the bearing case through supporting the bearing holder 61 with the arch-shaped wall, while the thickness of the rib walls can be reduced to make the bearing case more lightweight. Thereby, vibration and operation noise can also be absorbed and restricted more efficiently, resulting in overall enhancement of the product performance.

While the present invention is applied to an inclined type of engine in the embodiment described above, it is of course possible to apply the present invention to a normal engine in which the cylinder axis is arranged in the gravitational direction. Moreover, while the present invention is applied to an air-cooled engine with a single-cylinder, the present invention may alternatively be applied to an air-cooled engine with a multi-cylinder, or a liquid-cooled engine with a single- or multi-cylinder.

While the cylinder block 2 and the crank case 3 are formed integrally with each other in the embodiment described above, they may alternatively be provided separately, and the cylinder head 4 and the cylinder block 2 may be formed integrally with each other. In addition, while the valve-operating system 30 is provided by using the sprockets 31 and 32 and the chain 33 in the embodiment described above, the valve-operating system 30 may alternatively be provided by using other driving members known in the art, such as a cogged pulley and a cogged belt, or a timing pulley and a timing belt. Moreover, in the present invention, the term "rotation" has a general concept including a circular motion in both directions, i.e. a clockwise direction and a counterclockwise direction, not a circular motion in only one direction.

According to the bearing case of the present invention, rib walls are formed so as to surround the bearing holder, so that a force radially exerted to the bearing holder from a radial direction of the crankshaft can be received by these rib walls, whereby the rigidity of the bearing case is improved. Accordingly, the bearing holder is less likely to deform, and the crankcase mounting section is subjected to less moment, allowing for less play thereof. As a result, damage to the gasket caused by deformation or play of the bearing case can be prevented, whereby the lifetime and reliability of the product are improved.

Furthermore, since the rib walls are provided in the side of crankcase, it can be prevented that an oil surface of the oil pan lowers because the oil 9 enters the bearing case 7 due to the inclination of the engine. Therefore, even if the engine is located with inclination, the oil dipper sinks below the oil surface, thus securing the valve-operating system to be lubricated and improving the reliability of the engine.

While there have been described what are at present considered to be preferred embodiments of the present invention, it will be understood that various modifications may be made thereto, and it is intended that the appended claims cover all such modifications as fall within the true spirit and scope of the invention.

What is claimed is:

1. A bearing case attached to a crankcase of an engine in order to hold a bearing for supporting a crankshaft of said engine, comprising:

a bearing holder for holding said bearing;

a crankcase mounting section formed on an outer peripheral surface of said bearing case to be joined to said crankcase; and rib walls formed so as to surround said bearing holder and extend from said bearing holder to said crankcase mounting section, said rib walls being located adjacently to a side end surface of said crankcase.

2. The bearing case according to claim 1, wherein said rib walls are formed in a planar shape.

3. The bearing case according to claim 1, wherein said rib walls are formed in a spherical shape.

4. A bearing case attached to a crankcase of an engine in order to hold a bearing for supporting a crankshaft of said engine, comprising:

a bearing holder for holding said bearing;

a crankcase mounting section formed on an outer peripheral surface of said bearing case to be joined to said crankcase; and rib walls formed so as to surround said bearing holder and extend from said bearing holder to said crankcase mounting section.

5. The bearing case according to claim 4, wherein said rib walls are formed in a planar shape.

6. The bearing case according to claim 4, wherein said rib walls are formed in a spherical shape.

7. A bearing case attached to a crankcase of an engine in order to hold a bearing for supporting a crankshaft of said engine, comprising:

a bearing holder for holding said bearing;

a crankcase mounting section formed on an outer peripheral surface of said bearing case to be joined to said crankcase; and rib walls located adjacently to a side end surface of said crankcase.

8. The bearing case according to claim 7, wherein said rib walls are formed in a planar shape.

9. The bearing case according to claim 7, wherein said rib walls are formed in a spherical shape.

* * * * *